US011731857B2

(12) United States Patent
Rasanen et al.

(10) Patent No.: US 11,731,857 B2
(45) Date of Patent: Aug. 22, 2023

(54) MOVABLE MACHINE ROOM, ELEVATOR ARRANGEMENT AND METHOD FOR CONSTRUCTING ELEVATOR

(71) Applicant: Kone Corporation, Helsinki (FI)

(72) Inventors: Matti Rasanen, Helsinki (FI); Tarvo Viita-Aho, Helsinki (FI); Markku Haivala, Helsinki (FI); Jukka Laitinen, Helsinki (FI); Markku Haapaniemi, Helsinki (FI); Hans Valtonen, Helsinki (FI); Anssi Venho, Helsinki (FI); Janne Mikkonen, Helsinki (FI); Aki Haikonen, Helsinki (FI); Otto Lanz, Helsinki (FI); Janne Laine, Helsinki (FI); Jorma Mustalahti, Helsinki (FI); Jori Hagg, Helsinki (FI); Jari Osterman, Helsinki (FI); Petri Kere, Helsinki (FI)

(73) Assignee: Kone Corporation, Helsinki (FI)

( * ) Notice: Subject to any disclaimer, the term of this patent is extended or adjusted under 35 U.S.C. 154(b) by 213 days.

(21) Appl. No.: 17/162,459

(22) Filed: Jan. 29, 2021

(65) Prior Publication Data

US 2021/0245997 A1 Aug. 12, 2021

(30) Foreign Application Priority Data

Feb. 12, 2020 (EP) ..... 20156948

(51) Int. Cl.

| | |
|---|---|
| ***B66B 9/02*** | (2006.01) |
| ***B66B 11/00*** | (2006.01) |
| ***E04G 3/28*** | (2006.01) |

(52) U.S. Cl.

CPC ..... *B66B 9/02* (2013.01); *B66B 11/0015* (2013.01); *E04G 3/28* (2013.01); *E04G 2003/286* (2013.01)

(58) Field of Classification Search

CPC ... B66B 9/02; B66B 11/0045; B66B 11/0015; B66B 9/16; E04G 3/28; E04G 2003/286; E04G 1/367

See application file for complete search history.

(56) References Cited

U.S. PATENT DOCUMENTS 1,365,252 A * 1/1921 Langill ..... B66F 7/0608 52/109
4,706,779 A * 11/1987 Bono ..... B66B 9/16 182/2.11

(Continued)

FOREIGN PATENT DOCUMENTS

CN 110469106 A * 11/2019
EP 2275377 A1 1/2011

(Continued)

OTHER PUBLICATIONS

Machine translation of the description of FR 2782072 A1 (Year: 1998).*

(Continued)

*Primary Examiner* — Michael R Mansen
*Assistant Examiner* — Michelle M Lantrip
(74) *Attorney, Agent, or Firm* — Harness, Dickey & Pierce, P.L.C.

(57) ABSTRACT

The invention relates to a movable machine room comprising a support platform of a hoisting machine, the support platform comprising one or more releasable mounting mechanisms for releasably mounting the moveable machine room in a hoistway, and a hoisting machine mounted on the support platform; a working platform on top of the support platform, preferably forming a roof of the moveable machine room and/or comprising handrails; and at least one support structure supported by which the working platform rests on the support platform; and wherein each said support structure is selectively actuatable to expand in vertical (Continued)

direction for hoisting the working platform higher above the support platform taking reaction force from the support platform, or to contract in vertical direction for lowering the working platform back towards the support platform. The invention relates to an arrangement and a method implementing the movable machine room.

16 Claims, 8 Drawing Sheets

(56) References Cited

U.S. PATENT DOCUMENTS

| | | | | |
|---|---|---|---|---|
| 4,752,102 | A * | 6/1988 | Rasmussen | A47C 3/24 187/244 |
| 5,481,988 | A * | 1/1996 | Dess | B66B 9/16 108/106 |
| 9,169,107 | B2 | 10/2015 | Wilts et al. | |
| 2003/0136611 | A1 * | 7/2003 | Erny | B66B 19/00 187/401 |
| 2012/0023863 | A1 * | 2/2012 | Van Der Meijden | B66F 7/20 187/254 |
| 2013/0233655 | A1 * | 9/2013 | Peacock | B66B 19/00 187/414 |
| 2020/0062549 | A1 * | 2/2020 | Kim | B66B 19/007 |

FOREIGN PATENT DOCUMENTS

| | | | | |
|---|---|---|---|---|
| FR | 2694279 | A1 * | 2/1994 | B66B 19/00 |
| FR | 2782072 | A1 | 2/2000 | |
| JP | 2015000798 | A * | 1/2015 | B66B 19/00 |
| WO | WO-2006010782 | A2 * | 2/2006 | B66B 19/002 |
| WO | WO-2010/100319 | A1 | 9/2010 | |
| WO | WO-2011080387 | A1 * | 7/2011 | B66B 19/00 |

OTHER PUBLICATIONS

Extended European Search Report for European Patent Application No. 20156948 dated Aug. 25, 2020.

* cited by examiner

MOVABLE MACHINE ROOM, ELEVATOR ARRANGEMENT AND METHOD FOR CONSTRUCTING ELEVATOR

RELATED APPLICATIONS

This application claims priority to European Patent Application No. EP20156948.0 filed on Feb. 12, 2020, the entire contents of which are incorporated herein by reference.

FIELD OF THE INVENTION

The invention relates to a movable machine room of an elevator, an elevator arrangement and a method for constructing an elevator. The elevator is preferably an elevator for transporting passengers and/or goods.

BACKGROUND OF THE INVENTION

In connection with so-called jump-lifts, the bottom part of an elevator hoistway is taken into use before the building has been completed. In this case the upper parts of the building as well as the top part of the elevator hoistway can be constructed at the same time as an elevator moving in the bottom part of the elevator hoistway already serves people on the lower floors of the building under construction. Typically in jump-lifts the elevator car moving in the lower parts of the elevator hoistway is supported and moved during construction-time use with a hoisting machine supported on a machine room which is vertically movable in the elevator hoistway.

The car can hang suspended from the movable machine room during its use for transporting passengers and/or goods below the movable machine room via a hoisting roping.

Typically, construction work in the hoistway above the vertically movable machine room has been performed by working on a installation platform suspended from above and movable above the movable machine room, or alternatively by working on scaffolds mounted in the hoistway.

When the elevator hoistway under construction above the vertically movable machine room has reached a sufficient stage of completion, the completed part of the elevator hoistway can be taken into use. At this stage a "jump" is performed, wherein the vertically movable machine room is hoisted higher in the elevator hoistway. Thereafter, the car can reach a higher position than before the jump and start to serve additional floors.

In prior art, a drawback has been that performing construction work above the movable machine room has required complicated arrangements and platforms to be installed in the hoistway.

BRIEF DESCRIPTION OF THE INVENTION

The object of the invention is to introduce an improved method for constructing an elevator. An object is particularly to introduce a solution by which one or more of the above defined problems of prior art and/or drawbacks discussed or implied elsewhere in the description can be solved. An object is particularly to simply and safely enable construction work above the movable machine room of a jump lift.

It is brought forward a new movable machine room comprising a support platform of a hoisting machine, the support platform comprising one or more releasable mounting mechanisms for releasably mounting the moveable machine room in a hoistway, and a hoisting machine mounted on the support platform; a working platform on top of the support platform, preferably forming a roof of the moveable machine room and/or comprising handrails; and at least one support structure supported by which the working platform rests on the support platform; and wherein each said support structure is selectively actuatable to expand in vertical direction for hoisting the working platform higher above the support platform, in particular taking reaction force from the support platform, or to contract in vertical direction for lowering the working platform back towards the support platform.

With this kind of solution one or more of the above mentioned objects can be achieved. Particularly, hereby it is simply and safely enabled construction work above the movable machine room of a jump lift. Back and forth movement is achieved and working can be performed above the support platform at different heights. It is also enabled that working can be performed relatively high above the support platform and thereafter the working platform lowered back towards the support platform. It is also enabled that the movable machine room can be made compact again and relatively easy and rigid to hoist vertically to a higher position in the hoistway.

Preferable further details of the movable machine room are introduced in the following, which further details can be combined with the movable machine room individually or in any combination.

In a preferred embodiment, the movable machine room comprises an operating interface operable to control actuation of the at least one selectively actuatable support structure. Thereby operation of the actuation is facilitated.

In a preferred embodiment, the operating interface is in the form of an operating panel such as a push button panel or a touch screen, for instance.

In a preferred embodiment, the operating interface is connected to the actuating means of the at least one selectively actuatable support structure of the movable machine room.

In a preferred embodiment, the operating interface is mounted on a structure of the working platform, such as fixedly on a structure of the working platform or on a holder fixedly mounted on a structure of the working platform. Thus, a person can have himself lifted on the working platform to an optimal working position.

In a preferred embodiment, the support platform bears the full weight of the working platform via the at least one selectively actuatable support structure.

In a preferred embodiment, said support structure is in said actuation to expand preferably actuatable to expand from a contracted state at least 2 meters in vertical direction for hoisting the working platform at least 2 meters. The distance being substantially long is, for instance, enough in many sites to allow moving of the working platform vertically to be positioned from being near to one (landing) floor to near another (landing) floor, which allows easy installation of landing door components and/or access to/from the working platform. Likewise, the distance being substantially long is, for instance, enough in many sites to allow moving of the working platform vertically to be positioned from being near to one bracket position to near another bracket position.

It is also brought forward a new elevator arrangement comprising a hoistway and a movable machine room as described anywhere above or later in this application, which movable machine room is mounted in a transport position in the hoistway vertically supported on stationary structures, and an elevator car in the hoistway below the movable machine room.

With this kind of solution one or more of the above mentioned objects can be achieved.

Preferable further details of the arrangement are introduced in the following, which further details can be combined with the arrangement individually or in any combination.

In a preferred embodiment, arrangement comprises a hoisting arrangement for hoisting the movable machine room taking support from a support structure mounted above the movable machine room, preferably a support structure mounted in the hoistway above the movable machine room.

In a preferred embodiment, the arrangement comprises a hoisting arrangement for hoisting the movable machine room, which hoisting arrangement is separate from the at least one selectively actuatable support structure.

In a preferred embodiment, the support platform bears the full weight of the working platform via the at least one selectively actuatable support structure.

It is also brought forward a new method for constructing an elevator, the method comprising providing a hoistway; and providing an elevator car in the hoistway; and mounting a movable machine room to a transport position in the hoistway vertically supported on stationary structures, wherein the movable machine room is as described anywhere above. The method comprises using (first using) the elevator car for transporting passengers and/or goods below the movable machine room while the movable machine room is mounted in said transport position.

In a preferred embodiment, the method comprises, in particular after a period of said first using and a period of said using the working platform, hoisting the movable machine room upwards to a second transport position; wherein the second transport position is higher than said first transport position; and thereafter mounting the movable machine room to the second transport position in the hoistway vertically supported on stationary structures; and thereafter using (second using) the elevator car for transporting passengers and/or goods below the movable machine room while the movable machine room is mounted in said second position.

In a preferred embodiment, the method comprises, while the movable machine room is in a transport position (I or II) in the hoistway, using the working platform for installing elevator components from the working platform in the parts of the hoistway above the support platform, said using comprising moving the working platform up and down with the at least one selectively actuatable support structure.

In a preferred embodiment, said using the working platform is performed during said first using and/or the second using. In particular, said using the working platform comprises moving the working platform up and down with the at least one selectively actuatable support structure simultaneously with the first using and/or the second using.

In a preferred embodiment, each said selectively actuatable support structure is not actuated during the hoisting of the movable machine room. Preferably, before the hoisting of the movable machine room upwards, each support structure of the movable machine room is locked from being expandable. Hereby, accidental expansion during said hoisting is blocked.

In a preferred embodiment, each said selectively actuatable support structure is in a contracted state during the hoisting of the movable machine room. Hereby, the movable machine room is compact and relatively easy and rigid to hoist vertically to a higher position in the hoistway.

In a preferred embodiment, said using the working platform comprises one or more times actuating the support structure to expand in vertical direction for hoisting the working platform higher above the support platform; and one or more times actuating the support structure to contract in vertical direction for lowering the working platform back towards the support platform.

In a preferred embodiment, said using the working platform comprises receiving user input by an operating interface, and actuating the selectively actuatable support structure based on said user input.

In a preferred embodiment, said using the working platform comprises placing a guide rail section on top of an earlier fixed guide rail section and fixing it with brackets immovably into the hoistway.

In a preferred embodiment, said first and/or second using comprises receiving call signals from one or more user interfaces, such as one or more user interfaces located at floors and/or in the elevator car and/or mobile user interfaces, and moving the elevator car in response to said call signals automatically controlled by an elevator control system.

In a preferred embodiment, each said selectively actuatable support structure comprises an upright mast selectively actuatable to expand or contract in vertical direction.

In a preferred embodiment, each said upright mast comprises plurality of parallel elongated mast members movable along each other. Preferably, said plurality of parallel elongated mast members comprises at least a first mast member and a second mast member, which have interlocking profiles which are moveable along each other.

In a preferred embodiment, said elongated mast members are vertically oriented beams and the support structure comprises an actuating means for moving them along each other for expanding the mast or contracting the mast.

In a preferred embodiment, the actuating means comprise a motor arranged to rotate a drive wheel around which a flexible member such as a belt (or alternatively a cable or chain), passes and rotation of the wheel is arranged to move the flexible member. The flexible member is preferably arranged to pass over a wheel mounted in the upper end of a first mast member and back downwards to a fixing point in the lower end of a second mast member or to a wheel mounted in the lower end of a second mast member which wheel particularly forms a support point where the flexible member can support via the wheel the second mast member. Thereby, rotation of the motor in one direction is arranged to pull the second mast member upwards relative to the first mast member and rotation of the motor in the other, i.e. opposite direction, is arranged to allow the second mast member to be moved downwards relative to the first mast member by gravity.

In a preferred embodiment, said support structure comprises a scissor jack mechanism selectively actuatable to expand or contract in vertical direction.

In a preferred embodiment, the method comprises mounting vertical guide rail lines in the hoistway for guiding movement of the elevator car and/or the movable machine room.

In a preferred embodiment, the movable machine room, in particular the support platform thereof, comprises a guide for guiding vertical movement of the movable machine room along a vertical guide rail line of the elevator car.

In a preferred embodiment, during each hoisting of the movable machine room, vertical movement of the movable machine room is guided by one or more guides comprised in the movable machine room which one or more guides run along one or more guide rail lines.

In a preferred embodiment, in said hoisting of the movable machine room, the movable machine room is hoisted with a hoisting arrangement taking support from a support structure mounted above the movable machine room, preferably a support structure mounted in the hoistway above the movable machine room.

In a preferred embodiment, in said hoisting of the movable machine room, the movable machine room is hoisted with a hoisting arrangement, which is separate from the at least one selectively actuatable support structure.

In a preferred embodiment, each said using elevator car for transporting passengers and/or goods comprises receiving call signals from one or more user interfaces, preferably from one or more user interfaces located at floors and/or in the elevator car and/or mobile user interfaces, and moving the elevator car in response to said call signals automatically controlled by an elevator control system.

In a preferred embodiment, each said mounting of the movable machine room is performed with at least one releasable mounting mechanism. The releasable mounting mechanism is preferably shiftable between a first state and a second state, where in said first state said mechanism engages a stationary structure to take support from it, and in said second state said mechanism is released from said engagement.

In a preferred embodiment, the releasable mounting mechanism comprises an arm which is movable to a first state where it vertically overlaps a bracket fixed stationary in hoistway, and back to a second state where it does not overlap said bracket so that it can bypass a bracket positioned above the aforementioned bracket when being hoisted together with the movable machine room.

In a preferred embodiment, the releasable mounting mechanism comprises an arm which is movable to be on top of a structure of a floor sill or the hoistway wall, such as (in the latter case) on top of a surface of a pocket formed in the wall of the hoistway or a beam, for example, and back away from being on top of said structure of a floor sill or the hoistway wall.

In a preferred embodiment, each said releasable mounting mechanism comprises a gripper suitable for releasably gripping a a guide rail section of a guide rail.

In a preferred embodiment, in the method when the movable machine room is mounted (i.e. in mounted state) in said first and/or second transport position, the support platform bears the full weight of the working platform via the at least one selectively actuatable support structure.

Preferably, the aforementioned stationary structures include one or more of the following: a guide rail section of a guide rail line, a hoistway wall, floor sill, a bracket by which a guide rail section of a rail line has been fixed to the hoistway or (some other) bracket fixed on a rail line e.g. for the purpose of supporting said movable machine room.

In a preferred embodiment, the car has an interior space suitable for receiving a passenger or passengers, and a door movable between open and closed state for opening and closing the interior space. Hereby, safe passenger transportation is facilitated.

BRIEF DESCRIPTION OF THE DRAWINGS

In the following, the present invention will be described in more detail by way of example and with reference to the attached drawings, in which.

The foregoing aspects, features and advantages of the invention will be apparent from the drawings and the detailed description related thereto.

DETAILED DESCRIPTION

Figure 1:
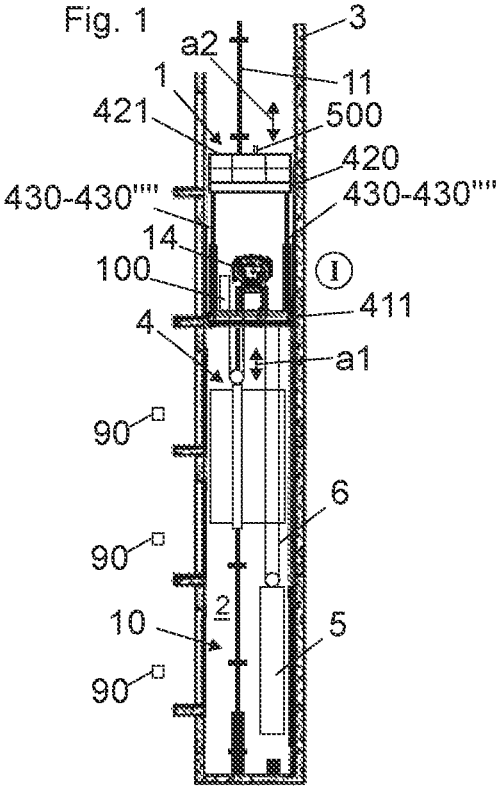
FIGS. 1-4 illustrate a movable machine room according to an embodiment and an elevator arrangement according to an embodiment in consecutive phases of a method for constructing an elevator according to an embodiment.

FIG. 1 illustrates an elevator arrangement in a phase of a method for constructing an elevator according to an embodiment. The method comprises providing a hoistway 2 in a building 3 and mounting vertical guide rail lines 10 in the hoistway 2 for guiding movement of the elevator car 4. The method moreover comprises mounting a movable machine room 1 to a transport position I in the hoistway 2 vertically supported on stationary structures as illustrated in FIG. 1. The method moreover comprises providing an elevator car 4 and a counterweight 5 in the hoistway 2 and connecting the elevator car 4 and the counterweight 5 with a suspension roping 6 hanging in the hoistway 2 supported by the movable machine room 1 and passing around at least one rope wheel 15 of the movable machine room 1, in particular a rope wheel (not showed) of a hoisting machine 14 which preferably is a drive wheel rotatable with a motor also comprised in the hoisting machine 14. The method comprises using (also referred to as first using) the elevator car 4 for transporting passengers and/or goods below the movable machine room 1 while the movable machine room 1 is mounted in said transport position I. The transportation use is illustrated by arrow a1 in FIG. 1. Said first using preferably comprises receiving call signals from one or more user interfaces 90, such as one or more user interfaces 90 located at floors and/or in the elevator car and/or mobile user interfaces, and moving the elevator car in response to said call signals automatically controlled by an elevator control system 100.

Figure 8:
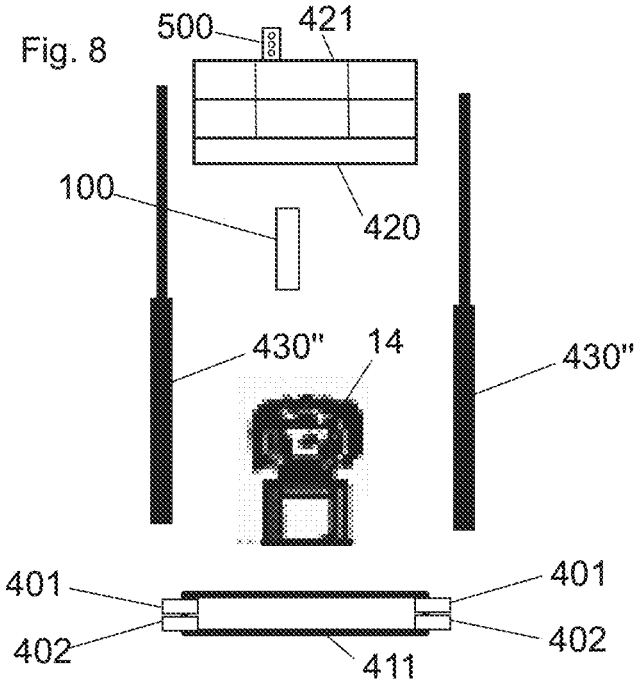
FIG. 8 illustrates an enlarged view of parts of the movable machine room of FIG. 1.

The movable machine room 1 comprises a support platform 411 of a hoisting machine 14, the support platform 411 comprising one or more releasable mounting mechanisms 402 for releasably mounting the moveable machine room 1 in a hoistway 2, and a hoisting machine 14 mounted on the support platform 411. The movable machine room 1 moreover comprises a working platform 420 on top of the support platform 411, the working platform 420 forming a roof of the moveable machine room 1 and comprising handrails 421, whereby a person can safely stand on it. The movable machine room 1 moreover comprises two support structures 430-430"" supported by which the working platform 420 rests on the support platform 411. The support platform 411 bears the full weight of the working platform 420 via the support structures 430-430"". The movable machine room 1 preferably also comprises an elevator control system 100 for automatically controlling movement of the elevator car 4, in particular by automatically operating the machinery 14. The control system 100 could alternatively be located elsewhere. Enlarged example of parts of the movable machine room 1 is illustrated in FIG. 8.

Each said support structure 430-430"" is selectively actuatable to expand in vertical direction for hoisting the working platform 420 higher above the support platform 411, in particular taking reaction force from the support platform 411, or to contract in vertical direction for lowering the working platform 420 back towards the support platform 411. Hereby, back and forth movement is achieved and working can be performed above the support platform 411 at different heights. It is also enabled that working can be performed relatively high above the support platform 411 and thereafter the working platform 420 lowered back towards the support platform 411 so that the movable machine room 1 becomes compact and relatively easy and rigid to hoist vertically to a higher position in the hoistway 2. Said term selectively actuatable means that the support structure 430-430" can be actuated both to expand and to contract and it can be selected which of said expanding or contracting is to be caused by the actuation.

Said support structure 430-430"" is in said actuation to expand preferably actuatable to expand from a contracted state at least 2 meters in vertical direction for hoisting the working platform 420 at least 2 meters. Hereby, the above mentioned advantages are substantially realized. The distance being substantially long, preferably at least 2 meters as mentioned, however preferably even longer, for instance is enough in many sites to allow moving of the working platform 420 vertically to be positioned from being near to one landing to near another landing, which allows easy installation of landing door components and/or access to/from the working platform. Likewise, the distance being substantially long, preferably at least 2 meters, preferably longer, for instance is enough in many sites to allow moving of the working platform 420 vertically to be positioned from being near to one bracket position to near another bracket position, which allows easy installation and/or use of the bracket e.g. during installation of a guide rail section or the bracket itself.

The method comprises, while the movable machine room 1 is in the transport position I in the hoistway 2, using the working platform 420 for installing elevator components from the working platform 420 in the parts of the hoistway 2 above the support platform 411, said using comprising moving the working platform 420 up and down with the selectively actuatable support structure 430-430"". Said moving the working platform 420 up and down is illustrated by arrow a2 in FIG. 1. Said using the working platform 420 is performed during said first using. Thus efficiency of the method is facilitated. The support platform 411 thus gives support for movable units 420 and 4 both above and below it simultaneously. This facilitates reduction of supporting means and counterpart supporting points.

Figure 5:
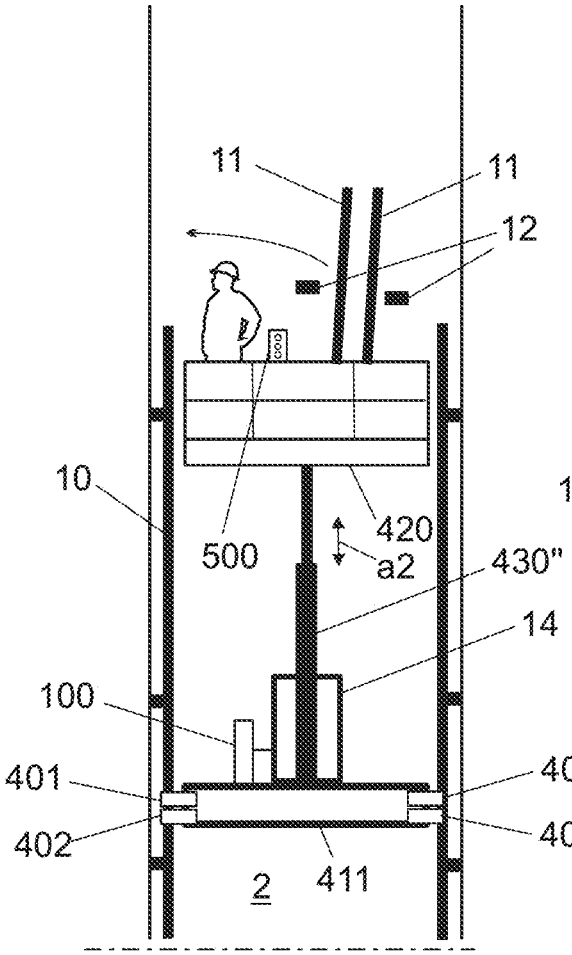
FIGS. 5 and 6 illustrates preferred details of the FIGS. 1 and 4 as viewed from a side.
Figure 6:
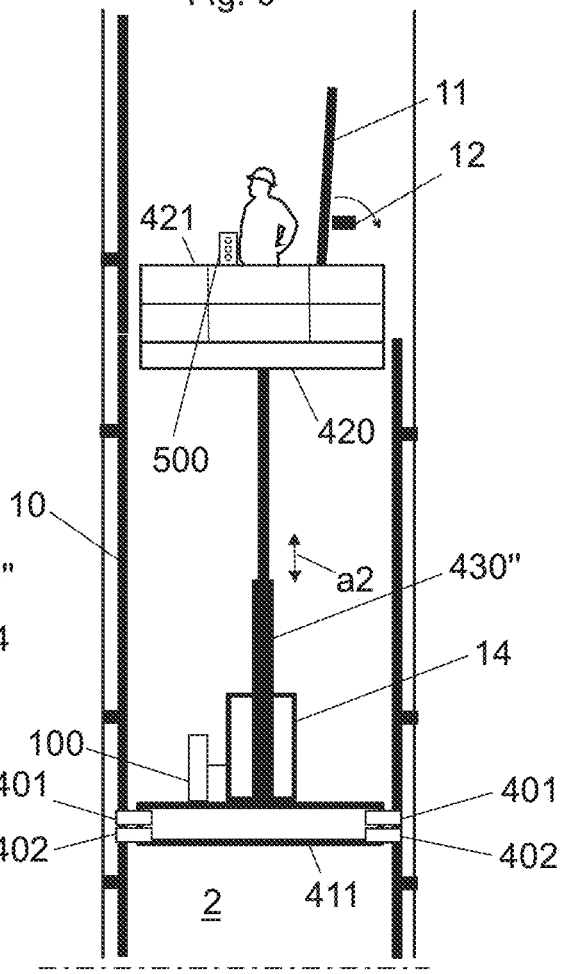

Said using the working platform 420 particularly comprises one or more times actuating the support structure 430-430" to expand in vertical direction for hoisting the working platform 420 higher above the support platform 411; and one or more times actuating the support structure 430-430" to contract in vertical direction for lowering the working platform 420 back towards the support platform 411. Thus, up and down movement a2 is achieved whereby material to be installed such as guide rail sections 11 or brackets 12 thereof, for instance, can be lifted to a desired height close to its installation place and/or the working position can be adjusted optimal. FIGS. 5 and 6 illustrate further preferred details of the using of the working platform 420 as well as further preferred details of the movable machine room 1 and the elevator arrangement in general. All parts, such as roping 6 or rope supply storage s, are not showed.

Figure 21:
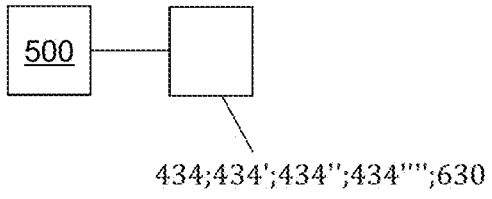
FIG. 21 illustrates an operating interface and its connection with the actuating means of the at least one selectively actuatable support structure.

Preferably, said using the working platform 420 comprises receiving by an operating interface 500 user input and actuating the selectively actuatable support structure based on said user input. For this purpose, the movable machine room 1 preferably comprises an operating interface 500 operable to control actuation of the selectively actuatable support structure. The operating interface 500 is preferably in the form of an operating panel such as a push button panel or a touch screen, for instance. The operating interface 500 is preferably connected, e.g. with wired or wireless connection, to actuating means of the at least one selectively actuatable support structure 430-430" of the movable machine room 1, as illustrated in FIG. 21. The operating interface 500 is preferably mounted on a structure of the working platform 420 as illustrated in FIGS. 1-6 and 7. Thus, a person can simply and safely have himself lifted on the working platform to an optimal working position. Most preferably it is mounted fixedly on a structure of the working platform 420 or mounted detachably on a holder fixedly mounted on a structure of the working platform 420. Thus, it can be of fixed or of mobile kind. As one option, the operating interface 500 can be a mobile device such as a phone or a tablet for instance, wherein a software application suitable for receiving user commands, is installed and/or running.

The guide rail lines 10 illustrated in FIG. 1, are provided by first mounting a number of guide rail sections 11 immovably into the hoistway 2 with brackets 12. As the method progresses, the guide rail lines 10 are extended gradually to reach higher by repeatedly placing a guide rail section 11 on top of an earlier fixed guide rail section 11 and fixing it with brackets 12 immovably into the hoistway 2, as illustrated in FIGS. 5 and 6. Accordingly, said using the working platform 420 preferably comprises placing a guide rail section 11 on top of an earlier fixed guide rail section 11 and fixing it with brackets 12 immovably into the hoistway 2. Hereby, the guide rail line(s) 10 can be constructed to extend higher during transport use of the elevator. FIG. 1 illustrates the guide rail section 11 already in place. For the sake of clarity, FIG. 1 illustrates only one guide rail line 10 which in this view is positioned behind the elevator car 4. Preferably, another guide rail line is positioned on opposite side of the car 4 so that the car is between guide rail lines 10. FIGS. 5 and 6 illustrate a side view from a different angle showing both of said guide rail lines 10.

Figure 7:
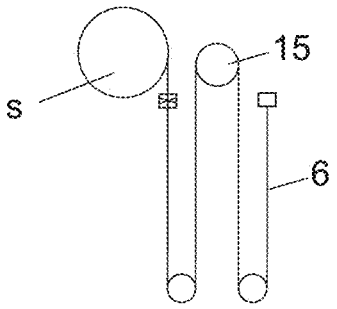
FIG. 7 illustrates preferred details of passage of the roping.

FIG. 7 illustrates preferred details of passage of the roping 6. In this case, one end of the roping 6 is fixed on the movable machine room 1, and from the fixing it passes down and around at least one rope wheel of the counterweight 5, and up to pass over said at least one rope wheel 15, again down and around at least one rope wheel of the car 4 and up to the movable machine room 1, and in particular to a releasable rope clamp, and through it to a rope supply storage in the form of one or more rope reels where the additional rope needed in the method can be taken from. The rope supply storage s can be preferably mounted on the movable machine room 1 but alternatively elsewhere, such as on a landing floor or in the pit of the hoistway.

The aforementioned mounting a movable machine room 1 to a transport position I in the hoistway 2 vertically supported on stationary structures as illustrated in FIG. 1 is performed using one or more releasable mounting mechanisms 402 comprised in the movable machine room 1. There are alternatives for the aforementioned stationary structures. Preferably, the aforementioned stationary structures include one or more of the following: a guide rail section 11 of a guide rail line 10, a hoistway wall 2*a*, floor sill, a bracket by which a guide rail section 11 of a rail line 10 has been fixed to the hoistway 2 or (some other) bracket fixed on a rail line 10 e.g. for the purpose of supporting said movable machine room. The preferred alternatives of the mounting mechanism 402 are later explained in further preferred details referring to FIGS. 9-11.

Figure 2:
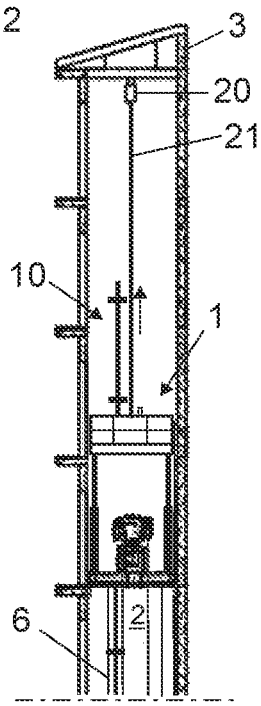
Figure 3:
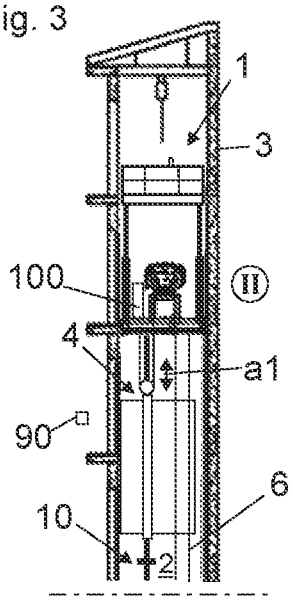

After a period of said using first using and a period of said using the working platform 420, the method comprises hoisting the movable machine room 1 upwards to a second transport position II, as illustrated in FIG. 2, the second transport position II being higher than said first transport position I, and thereafter mounting the movable machine room 1 to the second transport position II in the hoistway 2 vertically supported on stationary structures, as illustrated in FIG. 3. Said mounting is performed using one or more releasable mounting mechanisms 402 comprised in the movable machine room 1. There are alternatives for the aforementioned stationary structures as earlier mentioned.

In said hoisting of the movable machine room 1 upwards to a second transport position II, the movable machine room is preferably hoisted with a hoisting arrangement 20,21 taking support from a support structure 22 mounted in the hoistway 2 above the movable machine room 1.

Said support structure is preferably not actuated during the hoisting of the movable machine room 1, as illustrated in FIG. 2, for example. Preferably, before the hoisting of the movable machine room 1 upwards each support structure 430-430"" of the movable machine room 1 are locked from being expandable. Hereby, accidental expansion during said hoisting is blocked.

After said mounting the movable machine room 1 to the second transport position II, the method comprises using (also referred to as second using) the elevator car 4 for transporting passengers and/or goods below the movable machine room 1 while the movable machine room 1 is mounted in said second position II, as illustrated by arrow a1 in FIG. 3.

Said second using the elevator car 4 for transporting passengers and/or goods preferably comprises receiving call signals from one or more user interfaces 90, in particular one or more user interfaces 90 located at floors and/or in the elevator car and/or mobile user interfaces, and moving the elevator car 4 in response to said call signals automatically controlled by an elevator control system 100.

The method comprises, while the movable machine room 1 is in the second transport position II in the hoistway 2, using the working platform 420 for installing elevator components from the working platform 420 in the parts of the hoistway 2 above the support platform 411, said using comprising moving the working platform 420 up and down with the selectively actuatable support structure 430-430"". Said moving the working platform 420 up and down is illustrated by arrow a2 in FIG. 4. Said using the working platform 420 is performed during said second using. Thus, efficiency of the method is facilitated. The support platform 411 thus gives support for movable units 420 and 4 both above and below it simultaneously. This facilitates reduction of supporting means and counterpart supporting points.

The method may comprise (not showed), repeating correspondingly one or more times the sequence of a hoisting, a mounting and a subsequent using the elevator car 4 for transporting, wherein during each using of the elevator car performing said using the working platform 420.

At a suitable moment, in particular at least after the second using, the method may comprise converting the construction time elevator into a final elevator (not showed). Preferably, said converting comprises one or more of: removing the movable machine room 1 from the hoistway 2; building a new machine room; removing a roping 6 of the construction time elevator and installing a roping of the final elevator; modifying roping ratio, preferably comprising making the suspension ratio of the elevator car of the final elevator to be 1:1, where the suspension ratio of the elevator car of the construction time elevator is n:1 where n is larger than 1; removing a hoisting machine 14 of the construction time elevator; installing a hoisting machine of the final elevator; forming the car of the final elevator completely or at least partially of the car 4 of the construction time elevator.

Generally preferably, the movable machine room 1, in particular the support platform 411 thereof, comprises a guide 401 for guiding vertical movement of the movable machine room 1, in particular during hoisting thereof, along a vertical guide rail line 10 of the elevator car 4.

Generally, for enabling releasable, and thereby a temporary mounting, the movable machine room 1 comprises one or more releasable mounting mechanisms 402 for releasably mounting the movable machine room 1 vertically supported. Preferably, the releasable mounting mechanism 402 is shiftable between a first state and a second state, where in said first state said mechanism engages a stationary structure to take support from it, the stationary structure preferably being a hoistway wall 2*a*, floor sill, a bracket by which a guide rail section 11 of a rail line 10 has been fixed to hoistway or a bracket fixed on a rail line 10 e.g. for the purpose of supporting said movable machine room, or a guide rail section 11 of a guider rail line 10, and in said second state said releasable mounting mechanism 402 is released from said engagement.

Preferred embodiments of the releasable mounting mechanism 402 are described hereinafter.

Figure 9:
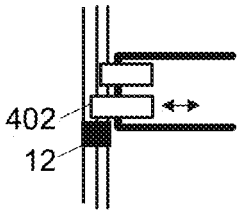
FIGS. 9-11 illustrate alternative preferred details of the releasable mounting mechanism.

In the embodiment of FIG. 9, the releasable mounting mechanism 402 comprises an arm which is movable to a first state where it vertically overlaps a bracket 12 fixed stationary in hoistway, and back to a second state where it does not overlap said bracket 12 so that it can bypass a bracket positioned above the aforementioned bracket 12 when being hoisted together with the movable machine room 1. In FIG. 9, the arm is movable between said states with a horizontal linear motion, but alternatively, it could be movable between said states with a pivoting motion.

Figure 10:
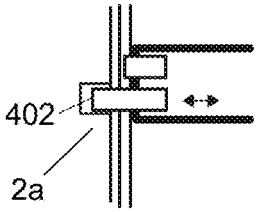

In the embodiment of FIG. 10, the releasable mounting mechanism 402 comprises an arm which is movable to be on top of a structure of the hoistway wall 2*a*, in particular on top of a surface of a pocket formed in the hoistway wall 2*a* and back away from being on top of said structure of the hoistway wall 2*a*, the first state here being a state where the arm extends to be on top of a structure of the hoistway wall 2*a*, and the second state being here a state where arm has been moved away from being on top of said structure of the hoistway wall. In the embodiment of FIG. 10, particularly the first state is a state where the arm extends into the pocket and the second state is a state where arm has been moved out from the pocket. Alternatively, structure of the hoistway wall 2*a* could be a beam of the hoistway wall and the surface could be an upper surface of the beam. Alternatively, the structure on top of which the arm is movable could be a floor sill, i.e. a sill of a doorway leading to a floor.

Figure 11:
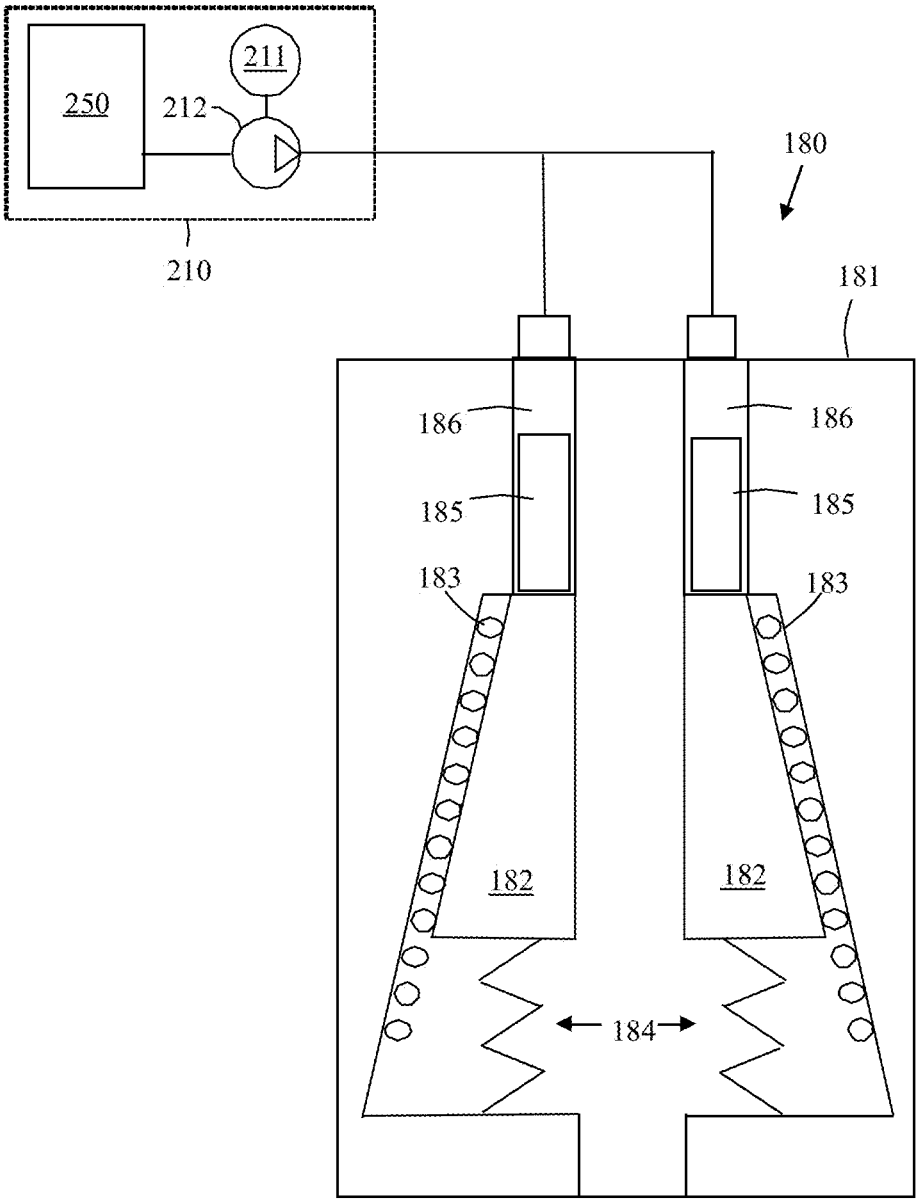

In the embodiment of FIG. 11, the releasable mounting mechanism 402 comprises a gripper 180 suitable for releasably gripping a guide rail section 11 of a guide rail line 10. In this case, the first state of the releasable mounting mechanism 402 is a state where the gripper grips a guide rail line 10 with gripping members on opposite sides of the guide rail section 11 of a guide rail 10, and the second state a state where said gripper does not grip a guide rail 10. Generally, a gripper suitable for releasably gripping a guide rail line 10 can be implemented with a wedging gripper wedging direction being downwards direction (as it is the case in the embodiment of FIG. 11) or alternatively with a fixed caliper brake or a floating caliper brake, for example. One or both of the gripping members can be movable to compress a guide rail section 11 of a guide rail line 10 between the gripping members and to release said compression. If only one of the gripping members is movable, then preferably the gripper has a frame (also known as caliper) of a floating kind in the manner known from caliper brakes. If both of the gripping members are movable, then preferably the gripper has a frame (also known as caliper) of a fixed kind in the manner known from caliper brakes. This is the case in the embodiment of FIG. 11.

The embodiment of FIG. 11 is more specifically as follows. The gripper 180 comprises a frame 181 with a slit for a guide rail line 10 and two wedge shaped brake shoes 182 as gripping members positioned on opposite sides of the guide rail line 10. The brake shoes 182 may be movably supported from the wedge surface with rollers 183 on the frame 181. A spring 184 may be positioned between a first end of the brake shoe 182 and the frame 181. A second opposite end of the brake shoe 182 may be supported on a slide 185 acting in a cylinder 186. A power unit, such as a hydraulic power unit 210 for instance, may provide power to the gripper 180. The hydraulic power unit 210 may comprise an electric motor 211, a hydraulic pump 212 and a reservoir 250. The hydraulic pump 212 pumps oil from the oil reservoir 250 to the cylinders 186 in order to move the slides 185 in the cylinders 186.

Supplying pressurized fluid to the plungers 185 in the cylinders 186 will press the brake shoes 182 downwards in the figure against the force of the springs 184. The brake shoes 182 are thus moved away from the guide surfaces of the guide rail line 10. The movable machine room 1 is thus free to move on the guide rail line(s) 10.

Extracting pressurized fluid from the cylinders 186 will allow the brake shoes 182 to move upwards in the figure due to the force caused by the springs 184 acting on the second end of the brake shoe 182. The brake shoes 182 are thus moved into contact with the guide surfaces of the guide rail line 10. The support platform 411 will thus become locked to the guide rail line 10.

The hydraulic unit 210 may be provided only for the gripper 180. Another possibility is to have a common main hydraulic unit on the working platform 420 for all equipment needing hydraulic power on the working platform 420. Hydraulic valves may be used to connect the different equipment to the common main hydraulic power unit.

The gripper 180 comprises in the embodiment of FIG. 11 two wedge shaped brake shoes 182.

The gripper 180 may as an alternative be operated electromechanically. An electromechanical device may be used to press the brake shoes 182 against the force of the springs 184. Deactivation of the electromechanical device will activate the brake shoes 182 against the guide rail line 10.

In addition to above described variations of brake construction, several other known type brake mechanics can be applied to fulfill above mentioned braking/gripping function. For instance, in some elevator system a brake system is comprised where gripping to a guide rail is produced via plier type jaws and associated friction lining. This lever type brake can be used as a further alternative.

Preferred details of the support structure 430-430"" are described hereinafter.

FIGS. 12-16 illustrate alternative embodiments of a support structure 430-430"" selectively actuatable to expand in vertical direction for hoisting the working platform 420 higher above the support platform 411, in particular taking reaction force from support platform 411, or to contract in vertical direction for lowering the working platform 420 back towards the support platform 411.

Figure 12:
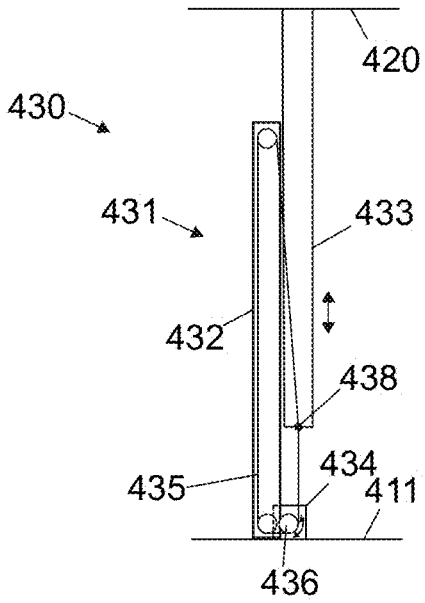
FIGS. 12-16 illustrate alternative preferred embodiments of the selectively actuatable support structure.

FIG. 12 illustrates schematically an embodiment, where the support structure 430 comprises an upright mast 431 selectively actuatable to expand or contract in vertical direction.

Said upright mast 431 is connected between the working platform 420 and the support platform 411. Said upright mast 431 comprises plurality of parallel elongated mast members 432,433 movable along each other. Said elongated mast members 432,433 are vertically oriented beams and the support structure comprises an actuating means 434,435 for moving them along each other for expanding the mast or contracting the mast 431. The elongated mast members 432,433 are supported against each other to be moved along each other so that one mast member guides the other, which can be implemented e.g. placing them in telescopic configuration or arranging them to have interlocking profiles moving along each other.

In the embodiment of FIG. 12, the actuating means 434;435 comprise a motor 434 arranged to rotate a drive wheel 436 around which a flexible member 435, such as a belt (or alternatively a cable or chain), passes and rotation of the wheel is arranged to move the flexible member 435. The flexible member 435 is arranged to pass over a wheel mounted in the upper end of a first mast member 432 and back downwards to a fixing point in the lower end of a second mast member 433. Thereby, rotation of the motor in one direction is arranged to pull the second mast member 433 upwards relative to the first mast member 432 and rotation of the motor in the other, i.e. opposite direction, is arranged to allow the second mast member 433 to be moved downwards relative to the first mast member 432 by gravity. The flexible member 435 passes on both sides of the drive wheel 436 to a fixing point 438 which fixing point 438 is arranged to move together with the second mast member 433 whereby flexible member 435 forms a loop and need not be reeled around the drive wheel 436. This is however another alternative way to implement the embodiment. In this case, one end of the flexible member 435 is fixed to a fixing point in the lower end of a second mast member 433 and the other end to a fixing point on the drive wheel 436.

Figure 13:
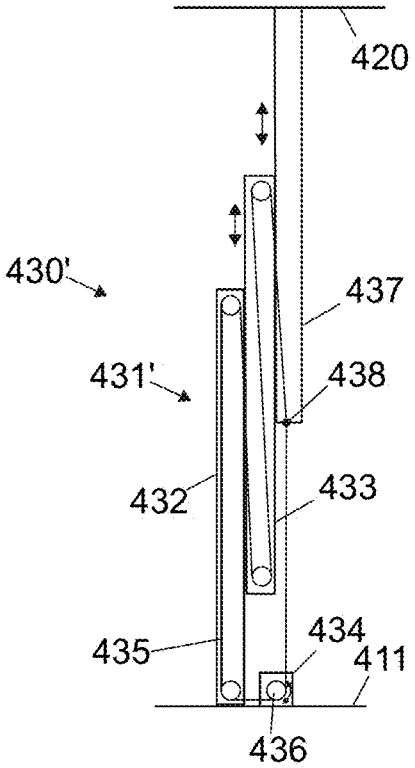

FIG. 13 illustrates schematically an embodiment, where the support structure 430' comprises an upright mast 431' selectively actuatable to expand or contract in vertical direction.

Said upright mast 431' is connected between the working platform 420 and the support platform 411. Said upright mast 431' comprises plurality of parallel elongated mast members 432,433, 437 movable along each other.

Said elongated mast members 432,433, 437 are vertically oriented beams and the support structure comprises an actuating means 434;435 for moving them along each other for expanding the mast or contracting the mast 431'. The elongated mast members 432,433, 437 are supported against each other to be moved along each other so that one mast member guides the other, which can be implemented e.g. placing them in telescopic configuration or arranging them to have interlocking profiles moving along each other.

In the embodiment of FIG. 13, the actuating means 434,435 comprise a motor 434 arranged to rotate a drive wheel 436 around which a flexible member 435, such as a belt (or alternatively a cable or chain), passes and rotation of the wheel is arranged to move the flexible member 435. The flexible member 435 is arranged to pass over a wheel mounted in the upper end of a first mast member 432 and back downwards and to pass to a wheel mounted in the lower end of a second mast member. The wheel mounted in the lower end of a second mast member particularly forms a support point where the flexible member can support via the wheel the second mast member. The flexible member 435 is arranged to pass around and under said wheel mounted in the lower end of a second mast member 433 and again upwards over a wheel mounted in the upper end of the second mast member 433, over it and back downwards to a fixing point in the lower end of the third mast member 437. Thereby, rotation of the motor in one direction is arranged to pull the second mast member 433 upwards relative to the first mast member 432, and rotation of the motor in the other, i.e. opposite direction, is arranged to allow the second mast member 433 to be moved downwards relative to the first mast member 432 by gravity. Moreover, rotation of the motor in one direction is arranged to pull the third mast member 437 upwards relative to the second mast member 433, and rotation of the motor in the other, i.e. opposite direction, is arranged to allow the third mast member 433 to be moved downwards relative to the second mast member 433 by gravity. The flexible member 435 passes on both sides of the drive wheel 436 to a fixing point 438 which fixing point 438 is arranged to move together with the third mast member 437 whereby flexible member 435 forms a loop and need not be reeled around the drive wheel 436. This is however another alternative way to implement the embodiment. In this case, one end of the flexible member 435 is fixed to a fixing point in the lower end of a third mast member 433 and the other end to a fixing point on the drive wheel 436.

Figure 14:
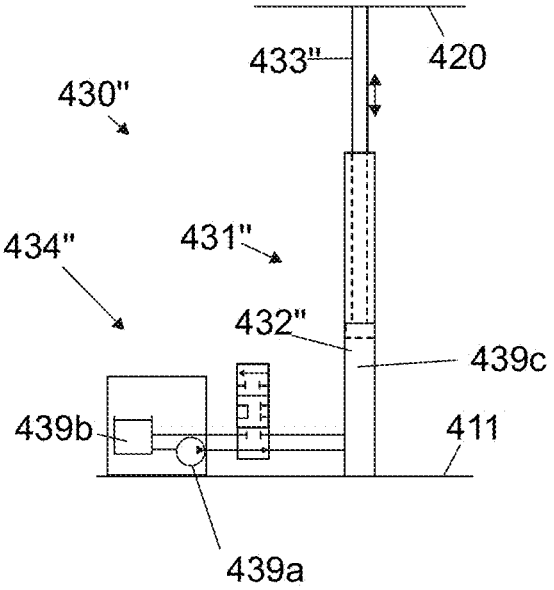

FIG. 14 illustrates schematically an embodiment, where the support structure 430" comprises an upright mast 431" selectively actuatable to expand or contract in vertical direction. Said upright mast 431" is connected between the working platform 420 and the support platform 411. Said upright mast 431" comprises plurality of parallel elongated mast members 432,433 movable along each other. Said elongated mast members 432,433 are vertically oriented hydraulic cylinder and piston, hydraulically selectively actuatable to expand or contract. The support structure comprises an actuating means 434" for moving them along each other for expanding the mast or contracting the mast 431, said actuating means comprising a hydraulic pump 439*a* and hydraulic fluid 439*b* stored in a reservoir for being pumped into a chamber 439*c* of the hydraulic cylinder.

Figure 15:
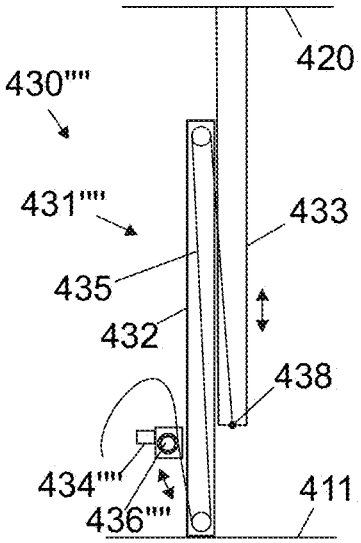

FIG. 15 illustrates schematically an embodiment, where the support structure 430" comprises an upright mast 431"" selectively actuatable to expand or contract in vertical direction.

Said upright mast 431"" is connected between the working platform 420 and the support platform 411. Said upright mast 431"" comprises plurality of parallel elongated mast members 432,433 movable along each other. Said elongated mast members 432,433 are vertically oriented beams and the support structure comprises an actuating means 434"",435 for moving them along each other for expanding the mast or contracting the mast 431"". The elongated mast members 432,433 are supported against each other to be moved along each other so that one mast member guides the other, which can be implemented e.g. placing them in telescopic configuration or arranging them to have interlocking profiles moving along each other.

In the embodiment of FIG. 15, the actuating means 434"";435 comprise a motor 434"" arranged to rotate a drive wheel 436"" against which a flexible member 435, such as a cable, belt or a chain, passes and rotation of the drive wheel 436"" is arranged to move the flexible member 435. In FIG. 15, the flexible member 435 spirals around the drive wheel 436'. The drive wheel is mounted on the movable machine room 1, preferably on the support platform 411. The flexible member 435 is arranged to pass over a wheel mounted in the upper end of a first mast member 432 and back downwards to a fixing point 438 in the lower end of a second mast member 433. Thereby, rotation of the motor 434" in one direction is arranged to pull the second mast member 433 upwards relative to the first mast member 432 and rotation of the motor 434"" in the other, i.e. opposite direction, is arranged to allow the second mast member 433 to be moved downwards relative to the first mast member 432 by gravity. The wheel 436"" is preferably a traction roll. The actuating means 434"";435 preferably comprise a traction hoist, such as a Tirak™ hoist for example, comprising said motor 434"" and the drive wheel 436"".

Figure 16:
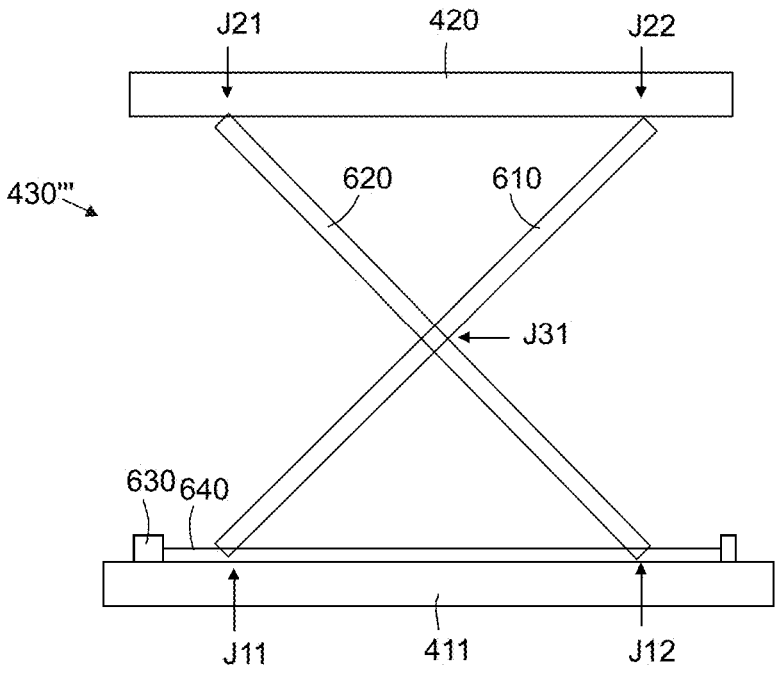

FIG. 16 illustrates schematically an embodiment, where the support structure 430'" comprises a scissor jack mechanism selectively actuatable to expand or contract in vertical direction.

In the preferred embodiment of FIG. 16, the scissor jack mechanism comprises two support arms 610, 620 connected via an articulated joint J31. The upper end of each support arm 610, 620 is connected via articulated joint J21, J22 with the the working platform 420. The lower end of each support arm 610, 620 is connected via an articulated joint J11, J12 with the support platform 411.

Each of the articulated joints J11, J12 at the lower deck 110 and each of the articulated joints J21, 122 at the upper deck 120 should be arranged so that movement of the ends of the support arms 610, 620 relative to each other in the horizontal direction is allowed, but movement of the ends of the support arms 610, 620 relative to each other in the vertical direction is prevented.

An actuating means 630, in particular an actuator 630 is arranged to actuate the scissor jack mechanism to selectively expand or contract in vertical direction. The actuator 630 may be connected to a rod 640 passing in a horizontal and mounted on the support platform 411 or on a pedestal or equivalent mounted thereon. The rod 640 may be formed as a worm screw. The lower end of the first support arm 610 could be attached via a shaft 640 to an actuator 630. The lower end of the first support arm 610 may be provided with articulated joint cooperating with the worm screw 640. The worm screw 640 may be attached via joint parts to the lower end portions of the support arms 610, 620. The outer ends of the worm screw 640 may be supported on the support platform 411. Rotation of the actuator 630 in a first direction will move the lower ends of the support arms 610, 620 towards each other, whereby the support platform 411 and working platform 420 are moved in a direction away from each other. Rotation of the actuator 630 in a second opposite direction will move the lower ends of the support arms 610, 620 away from each other, whereby the support platform 411 and working platform 420 are moved in a direction towards each other. The working platform 420 may thus be lifted or lowered relative to the support platform 411 selectively with the actuator 630. The actuator 630 may be formed of a motor, e.g. an electric motor rotating the worm screw 640. A pair of scissor jacks mechanism 600 may be used i.e. one articulated jack 600 may be positioned at each side edge of the support platform 411 and working platform 420. As an alternative to the worm screw, the actuator 630 of the scissor jack mechanism 600 could be a hydraulic cylinder-piston actuator.

The cylinder-piston actuator could then extend between the support platform 411 and an upper portion of either support arm 610, 620, for example. The scissor jack mechanism 600 could also comprise several layers of crosswise running support arms stacked upon each other. As a yet one more alternative, the hydraulic cylinder-piston actuator could be arranged horizontally to selectively push and pull one of the ends of the support arms 610, 620 along a guide rail.

Generally, regarding the actuation, gravity can be utilized to cause or aid the contraction. The actuation to contract does not necessitate actually producing movement with the actuating means 434, 435; 434', 435'; 434"; 630, such as rotation or a motor or shortening of a mast or contraction movement of a scissor jack mechanism for example. This is because for example mere shifting of the actuating means 434, 435; 434', 435'; 434"; 630 to free run or to braking mode could be utilized. For example, in the embodiments of FIGS. 12 and 13, the motor 434 could be shifted to free rotation or to produce a moment for braking the rotation caused by gravity so as to control the contraction. Likewise, for example in the embodiment of FIG. 14 the actuation to contract could include shifting the hydraulic circuit to cause pressure release in the chamber 439*c*, preferably in a controlled manner to maintain pressure for braking the contraction of the hydraulic cylinder caused by gravity so as to control the contraction. Likewise, for example in the embodiment of FIG. 16 the actuation to contract could include the actuator 630 could be shifted to free rotation or to produce a moment for braking the rotation caused by gravity so as to control the contraction.

Regarding alternatives of FIGS. 12-16, it is to be understood that the movable machine room 1, the arrangement and the method described referring to FIGS. 1-6 and 8 is implemented using the support structure 430" in accordance to embodiment of FIG. 14 and if and when the movable machine room 1 is to be implemented using one of the alternatives in accordance to embodiments of FIG. 12,13,15, or 16 this can be realized by replacing the support structure(s) 430" with the alternative the support structure(s) in question.

Generally, the support structures 430; 430'; 430"; 430"; 430"" can be positioned freely to fit layout, but preferably close to two opposite side edges of the support platform 411.

Figure 17:
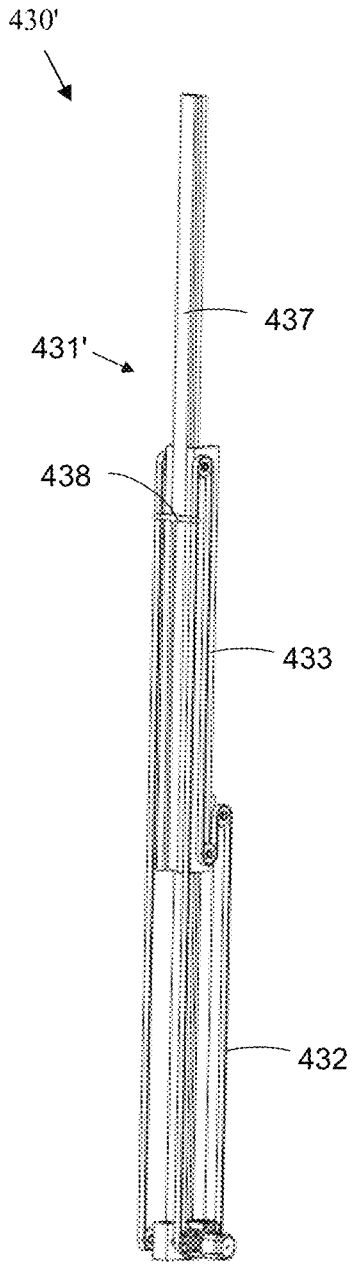
FIGS. 17-20 illustrate preferred further details of the the support structure of FIG. 13.
Figure 18:
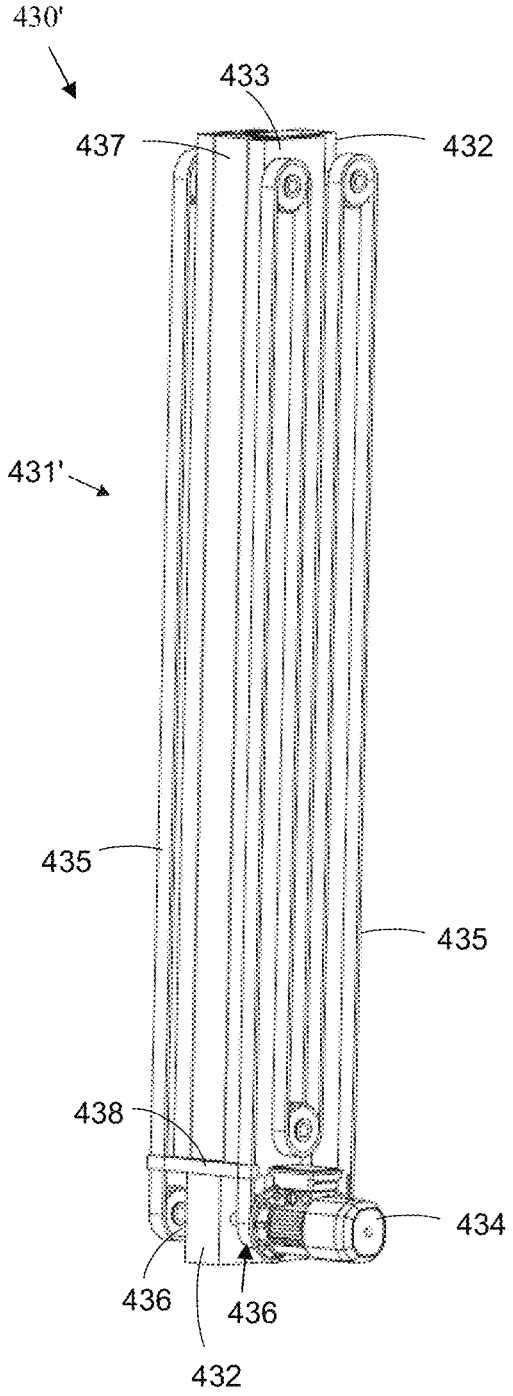
Figure 19:
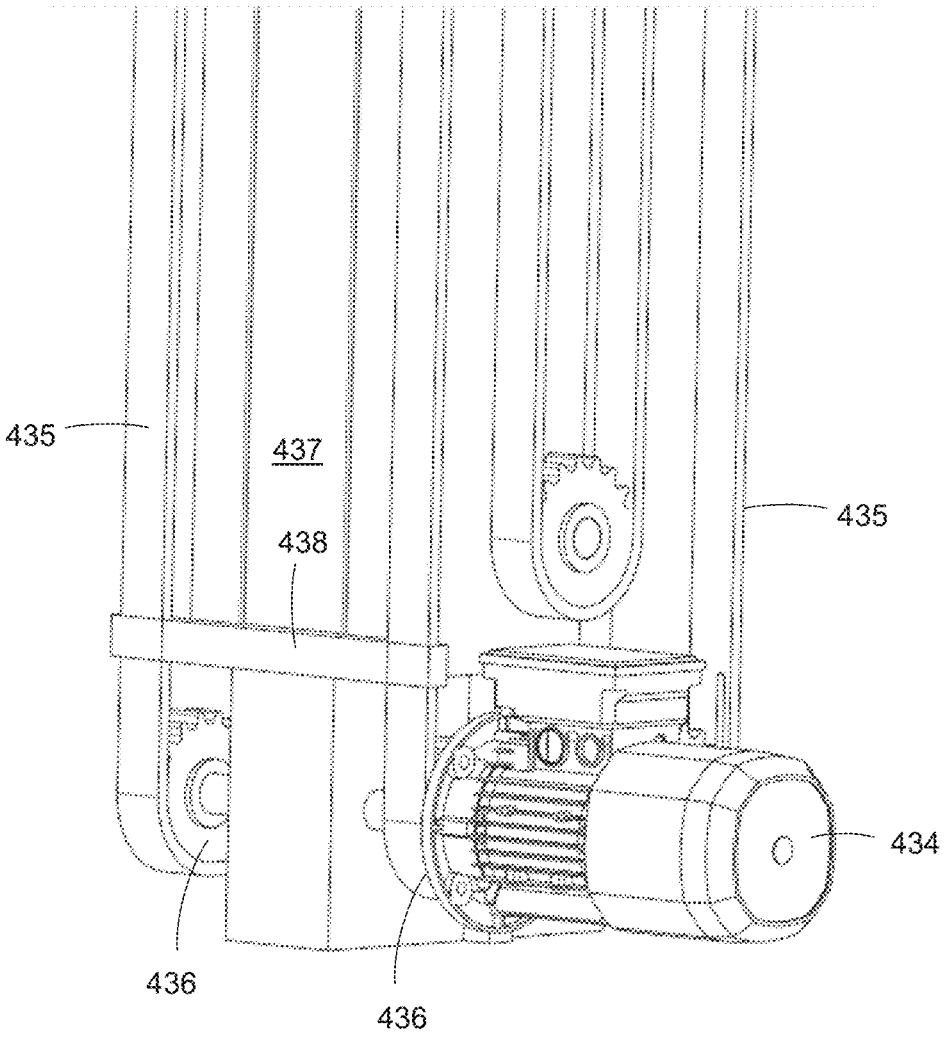
Figure 20:
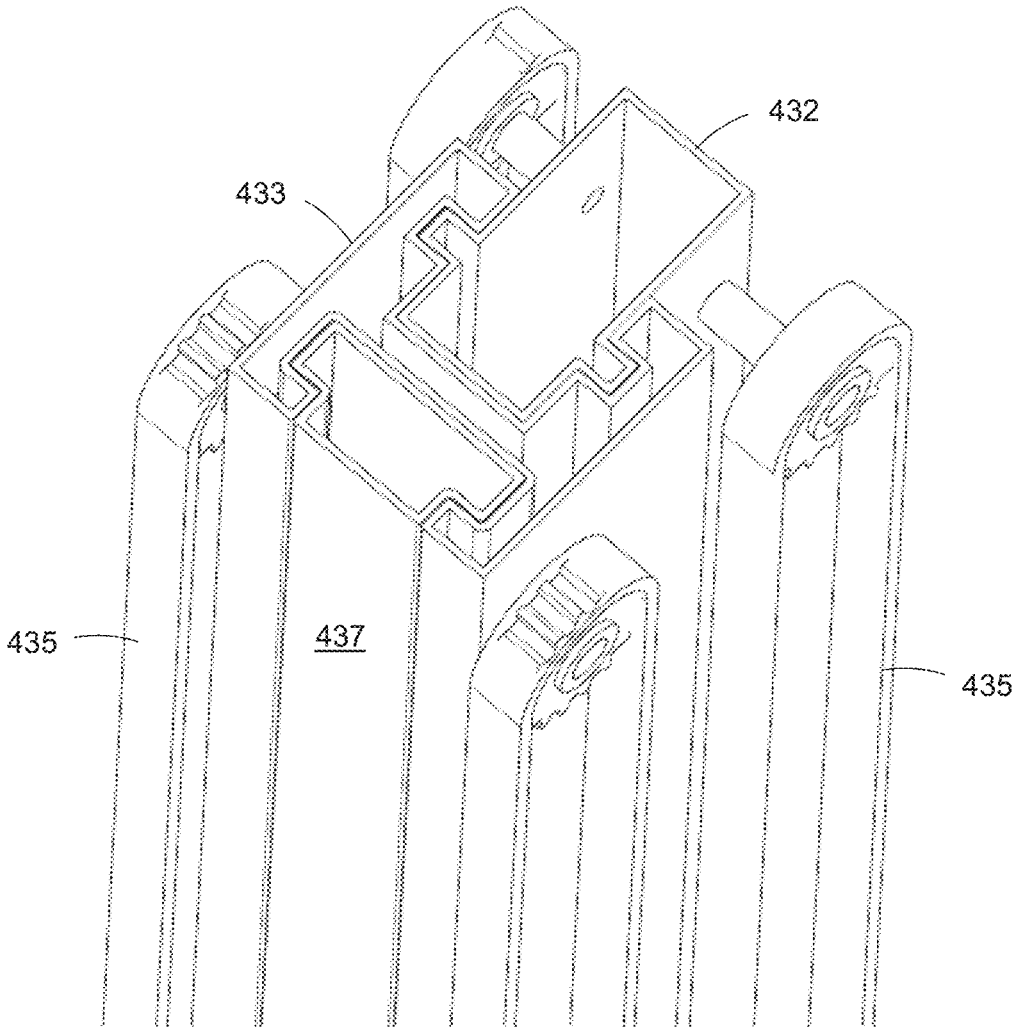

FIG. 17 shows preferred further details of the support structure 430' of FIG. 13. FIG. 17 shows the support structure 430' of FIG. 13 in expanded state and FIG. 18 in contracted state. FIG. 19 shows an enlargement of a lower portion of the support structure 430' shown in FIG. 17 and FIG. 20 shows an enlargement of an upper portion of the support structure 430' shown in FIG. 17.

The support structure 430' comprises an upright mast 431' selectively actuatable to expand or contract in vertical direction. Said upright mast 431' comprises three parallel vertically oriented elongated mast members 432,433, 437 movable along each other.

A second mast member 433 is supported with a form locking with a first mast member 432 and a third mast member 437 is supported with a form locking with the second mast member 433. The form locking of the elongated mast members 432,433, 437 is shown in FIG. 20.

The elongated mast members 432,433, 437 are supported against each other to be moved along each other so that the first mast member 432 guides the second mast member 433 and the second mast member 433 guides the third mast member 437. This is implemented such that the first mast member 432 and the second mast member 433 to have interlocking profiles which can move along each other, and the second mast member 433 and the third mast member 437 to have interlocking profiles which can move along each other.

The embodiment of FIGS. 17-20 is as described referring to FIG. 13 but it comprises two of the flexible members 435 and wheels connected with the mast members 432,433, 437. Particularly, in the embodiment of FIGS. 17-20, the actuating means 434,435 comprise a motor 434 arranged to rotate two drive wheels 436 and around each said drive wheels passes a flexible member 435 and rotation of each wheel 436 is arranged to move a flexible member 435. Each said flexible member 435 is arranged to pass as described referring to FIG. 13. As illustrated, the flexible member 435 is in this embodiment a cogged belt.

The movable machine room 1, its preferred features and alternatives have been described referring to FIGS. 1-20. In general, the movable machine room 1 comprises a support platform 411 of a hoisting machine 14, the support platform 411 comprising one or more releasable mounting mechanisms 402 for releasably mounting the moveable machine room 1 in a hoistway 2, and a hoisting machine 14 mounted on the support platform 411; a working platform 420 on top of the support platform 411, preferably forming a roof of the moveable machine room 1 and/or comprising handrails 421; and at least one support structure 430; 430'; 430"; 430'"; 430"" supported by which the working platform 420 rests on the support platform 411, wherein each said support structure 430; 430'; 430"; 430'"; 430"" is selectively actuatable to expand in vertical direction for hoisting the working platform (420) higher above the support platform 411 taking reaction force from the support platform 411, or to contract in vertical direction for lowering the working platform 420 back towards the support platform 411. The movable machine room 1 preferably moreover comprises an operating interface 500 operable to control actuation of the at least one selectively actuatable support structure.

Figure 4:
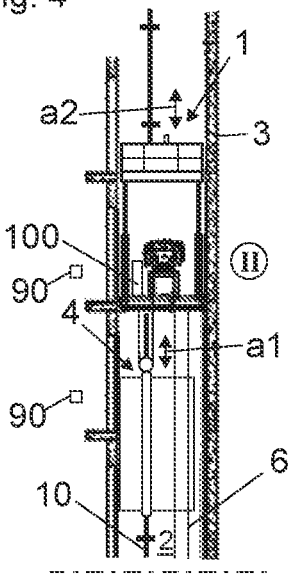

An elevator arrangement according to an embodiment has been disclosed in FIG. 1 as well as in FIG. 4. The elevator arrangement comprises a hoistway 2 and a movable machine room 1 as described in the preceding paragraph. The movable machine room 1 is mounted in a transport position I,II in the hoistway 2 vertically supported on stationary structures, and an elevator car 4 in the hoistway 2 below the movable machine room 1.

In the above, several alternatives for a selectively actuatable support structure are given. As a yet further alternative, the selectively actuatable support structure could be realized with a screw mechanism operated by an actuator. The actuator could be a motor, e.g. an electric motor. Gear racks, pinions and worm screws could be used in the screw mechanism.

Generally preferably, the working platform 420 is at least 1.5 meters, preferably at least 1.8 meters above the support platform 411 support platform 41, whereby a substantial space for working and/or safely dwelling between them is provided. This is the case preferably at all times. Accordingly, preferably when said at least one support structure 430; 430'; 430"; 430'" is in contracted state in a case where said at least one support structure 430; 430'; 430"; 430'" is selectively actuatable to expand or contract.

It is to be understood that the above description and the accompanying Figures are only intended to teach the best way known to the inventors to make and use the invention. It will be apparent to a person skilled in the art that the inventive concept can be implemented in various ways. The above-described embodiments of the invention may thus be modified or varied, without departing from the invention, as appreciated by those skilled in the art in light of the above teachings. It is therefore to be understood that the invention and its embodiments are not limited to the examples described above but may vary within the scope of the claims.

The invention claimed is:

1. A movable machine room comprising a support platform, the support platform including one or more releasable mounting mechanisms to releasably mount the movable room in a hoistway;

a hoisting machine mounted on the support platform;

a working platform on top of the support platform, the working platform being a roof of the movable machine room and the working platform including handrails; and at least one support structure configured to support the working platform such that the working platform rests on the support platform, the at least one support structure being selectively actuatable to expand in a vertical direction to hoist the working platform higher above the support platform or to contract in vertical direction to lower the working platform towards the support platform, wherein the at least one support structure is configured to be actuated to cause the working platform to move in the vertical direction in relation to the hoistway while the support platform is stationary in relation to the hoistway and the hoisting machine is causing an elevator car to move to transport at least one passenger and/or good below the movable machine room.

2. The movable machine room according to claim 1, the movable machine room further comprising:

an operating interface operable to control the actuation of the at least one support structure.

3. The movable machine room according to claim 2, wherein the operating interface is mounted on a structure of the working platform.

4. The movable machine room according to claim 1, wherein the support platform bears a full weight of the working platform via the at least one support structure.

5. The movable machine room of claim 1, wherein, the movable machine room is mounted in a transport position in the hoistway and vertically supported on stationary structures via the one or more releasable mounting mechanisms.

6. An arrangement, the arrangement comprising:

the movable machine room according to claim 1; and a hoisting arrangement to hoist the movable machine room, the hoisting arrangement being separate from the at least one support structure.

7. A method for constructing an elevator using the movable machine room according to claim 1, the method comprising:

mounting the movable machine room in a transport position in the hoistway, the movable machine room being vertically supported on stationary structures via the one or more releasable mounting mechanisms; and using the elevator car to transport the at least one passenger or good below the movable machine room while the movable machine room is mounted in the transport position.

8. The method according to claim 7, the method further comprising:

while the movable machine room is in the transport position, using the working platform to install an elevator component from the working platform in the hoistway above the support platform; and moving the working platform in the vertical direction based on actuating the at least one support structure.

9. The method according to claim 1, wherein the working platform is moved in the vertical direction while the elevator car is used to transport the at least one passenger or good.

10. The method according to claim 1, wherein moving the working platform vertically includes receiving an input via an operating interface, and actuating the at least one support structure based on the input.

11. The method according to claim 1, wherein the transport position is a first transport position, and the method further comprises:

hoisting the movable machine room upwards to a second transport position, the second transport position being higher than the first transport position;

mounting the movable machine room in the second transport position in the hoistway, the second transport position being higher than the first transport position;

using the elevator car to transport at least one further passenger or good below the movable machine room while the movable machine room is mounted in the second transport position.

12. The movable machine room according to claim 1, wherein each of the at least one support structure includes an upright mast selectively actuatable to expand or contract in the vertical direction.

13. The movable machine room according to claim 1, wherein each of the at least one support structure includes a scissor jack mechanism selectively actuatable to expand or contract in the vertical direction.

14. The method according to claim 11, wherein each of the at least one support structure is in a contracted state during an entire duration of the hoisting of the movable machine room.

15. The method according to claim 11, wherein moving the working platform vertically includes at least one of, actuating the at least one support structure one or more times to expand the vertical direction, the working platform being hoisted higher above the support platform each of the one or more times the at least one support structure is actuated; or actuating the at least one support structure one or more times to contract in the vertical direction, the working platform being lowered towards the support platform each of the one or more times the at least one support structure is actuated.

16. The method according to claim 10, wherein the movable machine room is hoisted with a hoisting arrangement, the hoisting arrangement being separate from the at least one support structure.

* * * * *